US006650221B2

(12) United States Patent
Oosuka et al.

(10) Patent No.: US 6,650,221 B2
(45) Date of Patent: Nov. 18, 2003

(54) IGNITION COIL FOR AN INTERNAL COMBUSTION ENGINE

(75) Inventors: Kazutoyo Oosuka, Gamagori (JP); Masami Kojima, Chiryu (JP); Keisuke Kawano, Kariya (JP)

(73) Assignee: Nippondenso Co., Ltd (JP)

( * ) Notice: Subject to any disclaimer, the term of this patent is extended or adjusted under 35 U.S.C. 154(b) by 0 days.

(21) Appl. No.: 09/996,600

(22) Filed: Nov. 30, 2001

(65) Prior Publication Data

US 2002/0057185 A1 May 16, 2002

Related U.S. Application Data

(62) Division of application No. 08/567,708, filed on Dec. 5, 1995, now Pat. No. 6,353,378.

(30) Foreign Application Priority Data

Dec. 6, 1994 (JP) ..... 6-302298
Dec. 9, 1994 (JP) ..... 6-306380
Jun. 8, 1995 (JP) ..... 7-141933

(51) Int. Cl.[7] ..... H01F 27/24
(52) U.S. Cl. ..... 336/234; 336/90; 336/96
(58) Field of Search ..... 123/634, 599, 123/647; 336/96, 90, 178, 198, 110, 229, 234

(56) References Cited

U.S. PATENT DOCUMENTS 1,835,870 A 12/1931 Henry
2,962,679 A 11/1960 Stratton
3,137,832 A 6/1964 Hurt, Jr. et al.
3,497,949 A * 3/1970 Salt ..... 336/178
4,035,751 A 7/1977 Walthew
4,082,866 A 4/1978 Link
4,136,322 A 1/1979 Maezima
4,459,967 A 7/1984 Hayashi
4,471,336 A 9/1984 Lundstrom et al.
4,530,782 A 7/1985 Meyer
4,557,039 A 12/1985 Manderson
4,617,907 A 10/1986 Johansson et al.
4,621,881 A 11/1986 Johansson et al.
4,706,638 A 11/1987 Johansson et al.
5,101,803 A 4/1992 Nakamura et al.
5,128,646 A 7/1992 Suzuki et al.
5,210,930 A 5/1993 Watabe et al.
5,307,044 A 4/1994 Watabe
6,353,378 B1 3/2002 Oosuka et al.

FOREIGN PATENT DOCUMENTS

DE 3620826 1/1987

(List continued on next page.)

OTHER PUBLICATIONS

Texbook J. Goldstein, "Die Messwandler," 1952, p. 22.

(List continued on next page.)

*Primary Examiner*—Anh Mai
(74) *Attorney, Agent, or Firm*—Nixon & Vanderhye PC

(57) ABSTRACT

An ignition coil for an internal combustion engine is mainly made up of a transformer part and a control circuit part and a connecting part, and the transformer part is made up of a iron core which forms an open magnetic path, magnets, a secondary spool, a secondary coil, a primary spool and a primary coil. By respectively setting the cross-sectional area $S_C$ of the iron core between 39 to 54 mm$^2$, the ratio of the cross-sectional area $S_M$ of the magnets with the cross-sectional area $S_C$ of the iron core in the 0.7 to 1.4 range, the ratio of the axial direction length $L_C$ of the iron core with the winding width L of the primary and secondary coils in the 0.9 to 1.2 range, and the winding width L in the 50 to 90 mm range, the primary energy produced in the primary coil can be increased without increasing the external diameter A of the case.

16 Claims, 15 Drawing Sheets

FOREIGN PATENT DOCUMENTS

| | | | |
|---|---|---|---|
| DE | 4039097 | A1 | 9/1990 |
| DE | 3915113 | | 11/1990 |
| EP | 0 159 067 | | 10/1985 |
| EP | 269347 | B1 | 6/1988 |
| EP | 431322 | | 6/1991 |
| FR | 2 232 050 | | 12/1974 |
| GB | 433970 | | 8/1935 |
| GB | 1219274 | | 1/1971 |
| GB | 2130806 | A | 6/1984 |
| JP | 45-38561 | | 12/1970 |
| JP | 50-088532 | | 7/1975 |
| JP | 51-038624 | | 3/1976 |
| JP | 58-25022 | | 2/1983 |
| JP | 59-105308 | | 6/1984 |
| JP | 63-040303 | | 2/1988 |
| JP | 1-110418 | | 7/1989 |
| JP | 2-228009 | | 9/1990 |
| JP | 3-165505 | | 7/1991 |
| JP | 4-087311 | | 3/1992 |
| JP | 4-171908 | | 6/1992 |
| JP | 7-153636 | | 6/1995 |

OTHER PUBLICATIONS

Kind D., Kamer H., Texbook, "Hochspannungs–Isoliertechnik," Vieweg–Verlag, 1982, pp. 138 and 154.

H. Frohne, "Leitfaden der Elektrotechnik," Band 4, Grundlagen der elektrischen Mebtechnik, Teubner, Stuttgart, 1984, pp. 40–41.

Lesch: Lehrbuch der Hochspannungstechnik, Springer–Verlag, 1959, p. 307.

Philippow, Taschenbuch Elektrotechnik, Band 2 Verlag Technik, 1965, p. 225.

Bodefeld Sequenz: "Elektrische Maschinen," Springer–Verlag, 1971, p. 4.

Aichholzer: "Elektromagnetische Energiewandler," vol. 1, Springer–Verlag, 1975, p. 213.

Avon, C.: "Der Transformator," C.W. Kreidel's Verlag, 1926, unamended reprint, 1990, p. 76.

Lehrbuch, "Die Transformatoren," von Rudolf Kuchler, Verlag Springer, 1966, pp. 274–279.

"EBG Gesellschraft fur elektromagnetische Werkstoffe MBH," Oct. 1990.

Coudederchon and Josso, "Toles magnetiques Alliages magnetiques doux.".

Beitz and Küttner, "Taschenbuch für den Maschinenbau," 1987.

* cited by examiner

IGNITION COIL FOR AN INTERNAL COMBUSTION ENGINE

CROSS-REFERENCE TO RELATED APPLICATIONS

This is a divisional application of application Ser. No. 08/567,708 filed Dec. 5, 1995 U.S. Pat. No. 6,353,378. This application is related to and claims priority from Japanese Patent Application Nos. Hei-6-306380, Hei-6-302298 and Hei-7-141933, the contents of which are hereby incorporated by reference.

BACKGROUND OF THE INVENTION

1. Field of the Invention

The present invention relates to an ignition coil for an internal combustion engine. More specifically, the present invention relates to an ignition coil for an internal combustion engine having an open magnetic path structure.

2. Description of Related Art

Conventionally, there are many known forms of ignition coils which supply high voltages to ignition plugs of internal combustion engines.

For example, Japanese Patent Laid Open Publication Nos. Hei-3-154311, Hei-2-228009 and Hei-3-13621 propose a cylindrical ignition coil.

This type of ignition coil should be containable in a plug hole of the internal combustion engine. Therefore, in order to provide powerful ignition sparks to the ignition plug, the ignition coil must be able to generate enough energy while having a small size at the same time.

In this way, the use of bias magnets has been proposed in the prior art but their sole use is not enough to balance both requirements for miniaturization and high-energy output.

An improvement in the iron core shape is one technology that has been proposed for miniaturizing a transformer. For example, Japanese Patent Laid Open Publication Nos. Sho-50-88532, Sho-51-38624, Hei-3-165505, etc. disclose an iron core whose substantially circular cross-section is formed by stacking various silicon sheets.

However, conventional technology was not able to raise the ratio of the area covered by the iron core with the area provided for it (referred to as occupation rate hereinafter) and thus, a high-level of miniaturization was not achieved.

SUMMARY OF THE INVENTION

In view of the foregoing problems of the prior art in mind, it is a goal of the present invention to provide a small-sized and high output ignition coil.

Also, the present invention aims to decrease the size and increase the energy output of slender cylindrical ignition coils. Another aim of the present invention is to decrease the size and increase the energy output of the ignition coil by optimizing a magnetic circuit used for the slender cylindrical ignition coil. In addition, the present invention aims to decrease the size and increase the energy output of the ignition coil by optimizing an iron core of the slender cylindrical ignition coil.

To achieve these aims, one aspect of the present invention provides an internal combustion engine ignition coil for supplying high voltages to an ignition plug of an internal combustion engine which includes a case, a cylindrical magnetic path constituting member which is housed in the case, and a coil housed inside the case and disposed at an outer periphery of an iron core of the cylindrical magnetic path constituting member and which includes a primary coil and a secondary coil, wherein the magnetic path constituting member is formed by stacking in a diameter direction of the magnetic path constituting member a plurality of magnetic steel sheets which have different widths with a cross-section in the diameter direction of the magnetic path constituting member being substantially circular, formed by the stacked magnetic steel sheets which define a circle circumscribing the edges of the magnetic steel sheets, the circle having a diameter of no more than approximately 15 mm, formed by the stacked magnetic steel sheets where each individual sheet has a thickness no more than 8% of the diameter of the circle circumscribing the edges of the sheets, formed by the stacked magnetic steel sheets of no less than six kinds of width, formed by the stacked magnetic steel sheets which number at least twelve sheets, and formed so that the stacked magnetic field sheets cover no less than 90% of the area of the circle circumscribing the edges of the sheets.

In this way, when this core is contained in a bobbin having inner contours which correspond to the circumscribing circle, the space that is wasted is reduce to no more than 10%. Thus, the electric voltage conversion efficiency between the coils wound up around the outer periphery of the bobbin can be improved. Also, by shaping the core to be inserted into the bobbin, the metal sheets can thus be held together by just inserting a cylinder stopper whose diameter is slightly smaller than that of the circumscribing circle without no need for fixing by pressing or the like. Thus, movement of the stacked magnetic sheets in the diametrical direction is prevented. Therefore, costs are lowered because there is no need for expensive press molds and the like.

Another aspect of the present invention provides an ignition coil wherein the plurality of stacked metal sheets have at least eleven kinds of width, the plurality of stacked metal sheets includes at least twenty-two sheets; and the plurality of stacked magnetic field sheets cover no less than 95% of the area of the circle circumscribing the edges of the sheets. In this way, the wasted space for the iron core is reduced to no more than 5%.

In another aspect of the present invention, a magnetic sheet having a thickness of no greater than 0.5 mm is stacked with other magnetic sheets having the same thickness. In this way, energy loss due to eddy currents can be reduced and thus, drops in the electrical voltage conversion efficiency are prevented.

In yet another aspect of the present invention, the magnetic sheets are directional silicon steel sheets.

A yet further aspect of the present invention provides an ignition coil wherein a cross-sectional area $S_C$ of the magnetic path constituting member in the diameter direction is $39 \leqq S_C \leqq 54$ and wherein the coil housing part of the case has an external diameter of less than 24 mm.

In this way, because the diameter direction cross-sectional area $S_C$ of the magnetic path constituting member is set to $S_C \geqq 39$ ($mm^2$), it is possible to produce the 30 mJ of electrical energy that the internal combustion engine demands, and because the diameter direction cross-sectional area $S_C$ is set to $S_C \leqq 54$ $mm^2$, it is possible to make the external diameter of the case to be less than 24 mm. Thus, without making the case external diameter larger than 24 mm, it is possible to produce the 30 mJ of electrical energy that the internal combustion engine demands. Therefore, the ignition coil for an internal combustion engine can be fitted in a plug tube having an internal diameter of 24 mm and the electrical energy necessary to effect spark discharge can be supplied to a spark plug.

An additional aspect of the present invention provides an ignition coil wherein the magnetic path constituting member defines a circle circumscribing the magnetic path constituting member where the circle has a diameter of no more than 8.5 mm.

Another aspect of the present invention provides an ignition coil wherein the magnetic path constituting member is formed by stacking bar-shaped magnetic steel sheets; and wherein the magnetic path has magnets disposed at both of its ends.

In this way, because the magnetic path constituting member is made by laminating steel sheets, eddy current losses can be reduced. As a result, there is the effect of increasing the electrical energy produced in the coil.

A yet further aspect of the present invention provides an ignition coil wherein surface ends of the magnetic path constituting member which is in contact with magnets is provided with a ditch in a direction that intersects with the plurality of stacked metal sheets with the plurality of stacked metal sheets being joined together by the ditch.

A further aspect of the present invention is that a ratio of an area $S_m$, of the end surfaces of the magnets facing the magnetic path constituting member with the cross-sectional area $S_c$ of the magnetic path constituting member is so set that $0.7 \leqq S_M/S_c \leqq 1.4$.

In this way, since a magnetic bias is applied because magnets are disposed on both ends of the magnetic path constituting member and the ratio of the area $S_M$ of the end surfaces of the magnets facing the magnetic path constituting member and the diameter direction cross-sectional area $S_C$ of the magnetic path constituting member is set to $S_M/S_C \geqq 0.7$, a magnet bias flux acts well, and also because $S_M/S_C \leqq 1.4$ is set, it is possible to make the external diameter of the case to be less than 24 mm. As a result, there is the effect of further increasing the electrical energy produced in the coil without making the case external diameter larger than 24 mm. Also, because the necessary number of magnets is two, it will be possible to reduce the number of magnets used more than with a conventional ignition coil for an internal combustion engine and also it will be possible to provide a cheap ignition coil for an internal combustion engine.

An additional aspect of the present invention is that the coil is wound up along an axial direction of the magnetic path constituting member with a ratio of an axial length $L_c$ of the magnetic path constituting member with a winding width L of the coil being set so that $0.9 \leqq L_c/L \leqq 1.2$ and winding width L (mm) being $50 \leqq L \leqq 90$.

In this way, because the ratio of the axial length $L_c$ of the magnetic path constituting member and the winding width L over which the coil is wound is set to $L_c/L \geqq 0.9$, the magnets disposed on the two ends of the magnetic path constituting member do not greatly enter the range of the coil winding width L and reduction of the effective flux of the coil due to the diamagnetic field of the magnets is suppressed, and because $L_c/L$ is set to $L_c/L \leqq 1.2$ the spacing of the magnets does not become too wide with respect to the coil winding width L and the magnets can be positioned on the two ends of the magnetic path constituting member in the range wherein a magnet bias flux acts well. Also, it is possible to further increase the electrical energy produced in the coil without increasing the case external diameter. As a result, since in correspondence with the secondary energy amount which the internal combustion engine demands, the external diameter of the case can be set smaller than for example 24 mm, and the necessary number of magnets can be one or a construction that does not use any magnets can also be adopted and in doing so, a cheap ignition coil can be provided for an internal combustion engine.

One other aspect of the present invention provides an internal combustion engine ignition coil for supplying a high voltage to an ignition plug of an internal combustion engine, where the ignition coil includes a case, a cylindrical magnetic path constituting member which is housed in the case, and a coil housed inside the case and disposed at an outer periphery of an iron core of the magnetic path constituting member and which includes a primary coil and a secondary coil, wherein an area $S_c$ ($mm^2$) of a cross-section of the magnetic path constituting member perpendicular to the length of the member is $39 \leqq S_c \leqq 54$; and wherein an outer diameter of the coil housing part of the case is less than 24 mm.

Another aspect of the present invention is that the cross-section of the magnetic path constituting member is substantially circular in shape where its cross-section defines a circle which circumscribes the cross-section and has a diameter of no more than 8.5 mm.

An additional aspect of the present invention provides an ignition coil wherein the magnetic path constituting member being formed by stacking magnetic steel sheets of different width.

Another aspect of the present invention is that magnets are disposed at both ends of the magnetic path constituting member.

In a further aspect of the present invention, a ratio of an area $S_m$ of the end surfaces of the magnets facing the magnetic path constituting member with the cross-sectional area $S_c$ of the magnetic path constituting member is set so that $0.7 \leqq S_M/S_c \leqq 1.4$.

A yet further aspect of the present invention is that the coil is wound up along an axial direction of the magnetic path constituting member, a ratio of an axial length $L_c$ of the magnetic path constituting member with a winding width L of the coil is set that $0.9 \leqq L_c/L \leqq 1.2$, and the winding width L (mm) is $50 \leqq L \leqq 90$.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PRESENTLY PREFERRED EXEMPLARY EMBODIMENTS

Preferred embodiments of the present invention are described hereinafter with reference to the accompanying drawings.

An embodiment of an ignition coil for an internal combustion engine according to the present invention is explained using FIGS. 1–25.

Figure 1A:
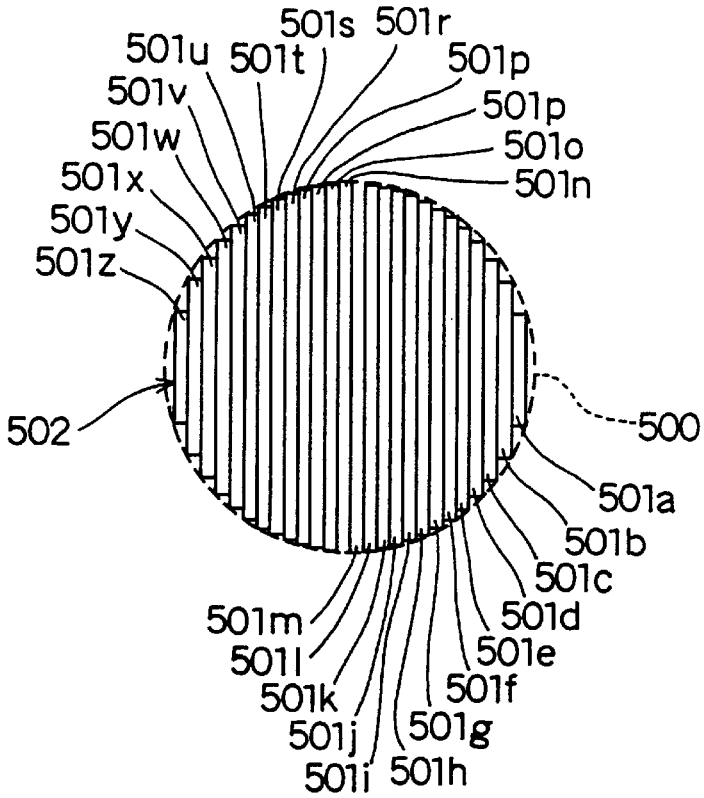
FIGS. 1A and 1B are traverse cross-sectional and side views, respectively, of an internal combustion engine ignition coil core according to a first embodiment of the present invention.
Figure 1B:
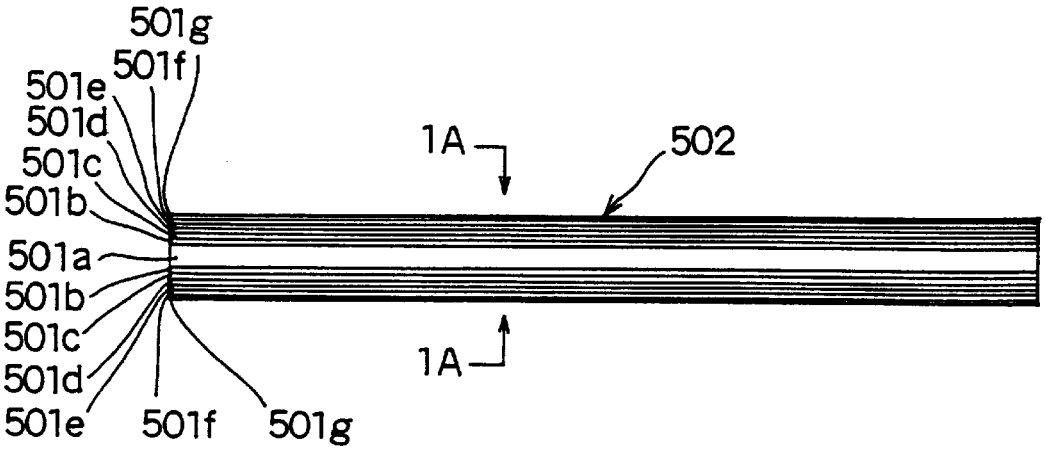

FIGS. 1A and 1B show flat and side views of a core (referred to as iron core hereinafter) 502 flat and side views. This iron core 502 is used in a transformer 5 part of an ignition coil 2 shown in FIG. 2.

Figure 2:
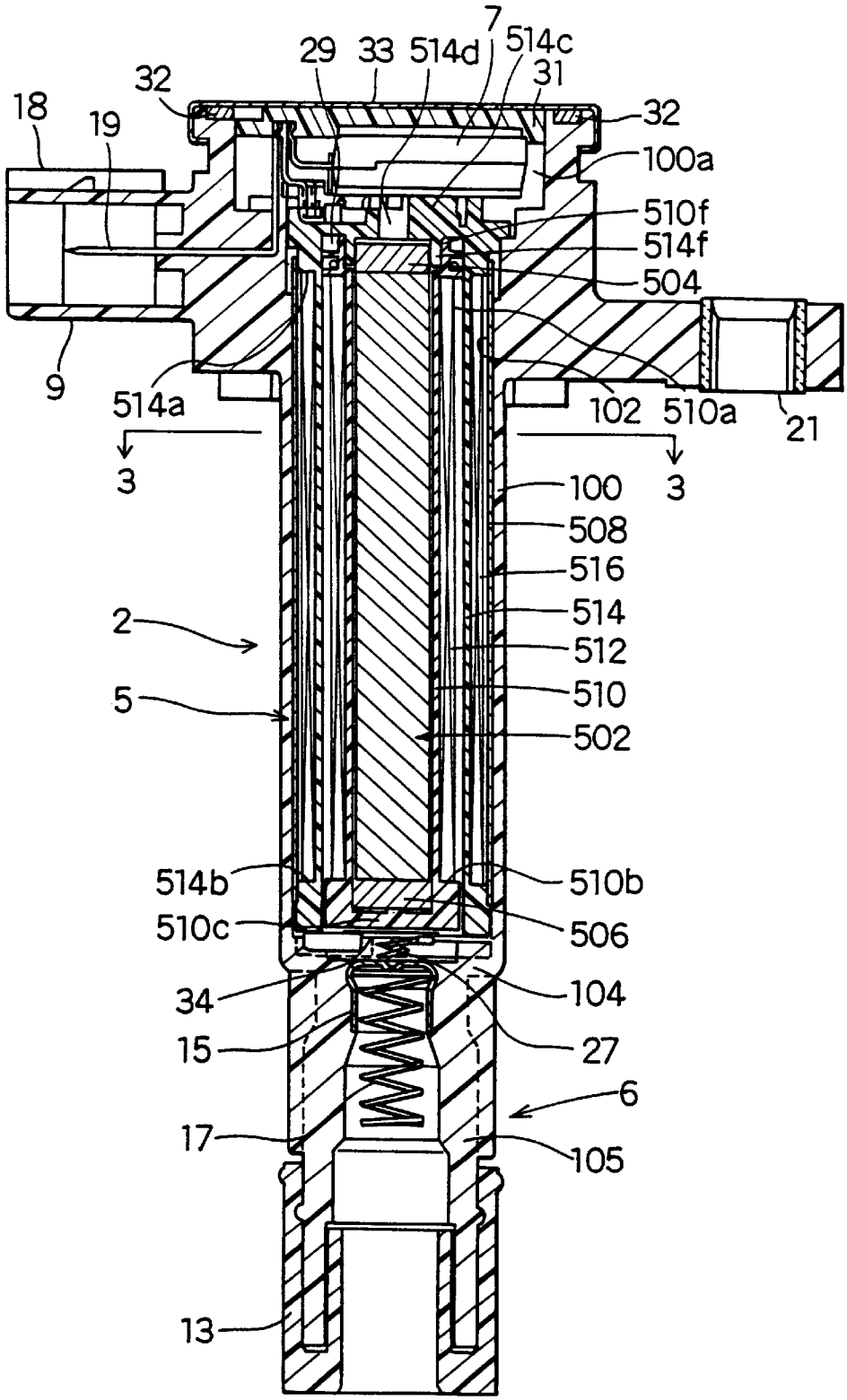
FIG. 2 is a longitudinal cross-section of the internal combustion engine installed with an iron core of the first embodiment.
Figure 3:
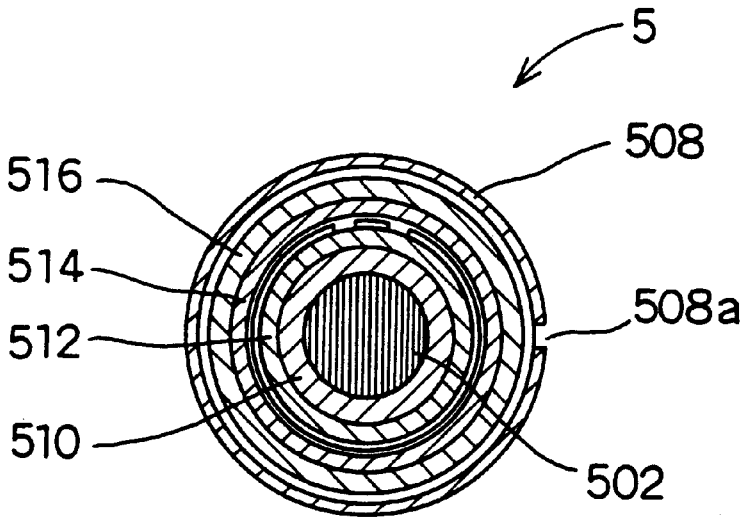
FIG. 3 shows a traverse cross-section of a transformer unit as seen from a III—III line shown in FIG. 2.

As shown in FIGS. 2 and 3, the ignition coil 2 for an internal combustion engine is mainly made up of a cylindrical transformer part 5, a control circuit part 7 positioned at one end of this transformer part 5 which interrupts a primary current of the transformer part 5, and a connecting part 6 positioned at the other end of the transformer part 5 which supplies a secondary voltage produced in the transformer part 5 to an ignition plug (not shown).

The ignition coil 2 has a cylindrical case 100 made of a resin material. This case 100 has an external diameter A of 23 mm and is sized so that it fits within the internal diameter of the plug tube not shown in the drawings. A housing chamber 102 is formed in an inner side of the case 100. The housing chamber 102 contains the transformer part 5 which produces high voltages, the control circuit 7 and an insulating oil 29 which fills the surroundings of the transformer part 5. An upper end part of the housing chamber is provided with a connector 9 for control signal input while a lower end part of the housing chamber 102 has a bottom part 104 which is sealed off by the bottom part of a cap 15 which is described later. An outer peripheral wall of this cap 15 is covered by the connecting part 6 positioned at the lower end of the case 100.

A cylindrical part 105 which receives an ignition plug (not shown) is formed in the connecting part 6, and a plug cap 13 made of rubber is fitted on an open end of this cylindrical part 105. The metal cap 15 which acts as a conducting member is inserted and molded into the resin material of the case 100 in the bottom part 104 that is positioned at the upper end of the cylindrical part 105. As a result, the housing chamber 102 and the connecting part 6 are divided so that there will be no exchange of liquids between the two.

A spring 17 restrained by the bottom part of the cap 15 is a compression coil spring. An electrode part of an ignition plug (not shown) makes electrical contact with the other end of the spring 17 when the ignition plug is inserted into the connecting part 6.

The bracket 11 which is used for mounting the ignition coil 2 is formed integrally with the case 100 and has a metal collar 21 molded therein. The ignition coil 2 for an internal combustion engine is fixed to an engine head cover (not shown) by a bolt, which is not shown in the drawings and which is disposed to pass through this collar 21.

The connector 9 for the control signal input includes a connector housing 18 and connector pins 19. The connector housing 18 is formed integrally with the case 100. Three connector pins 19, which are placed inside the connector housing 18, penetrate through the case 100 and are formed to be connectable from the outside by inserting them into the connector housing 18.

An opening 100*a* is formed on a top part of the case 100 for housing the transformer part 5, the control signal part 7, insulating oil 29 and the like in the housing chamber 102. The opening 100*a* is kept tightly closed by an O ring 32. Furthermore, a metallic cap 33 is fixed on the upper part of the case 100 to cover the surface of the radiation material cap 31.

The transformer part 5 is made up of an iron core 502, magnets 504, 506, a secondary spool 510, a secondary coil 512, a primary spool 514 and a primary coil 516.

Figure 4:
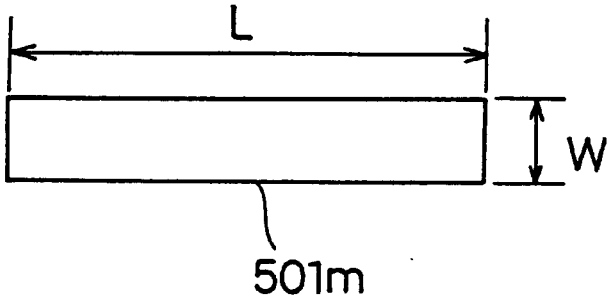
FIG. 4 is a diagram showing the dimensions of the steel sheets which form the iron core of the first embodiment.

As shown in FIGS. 1 and 4, the cylindrical iron core 502 is assembled by stacking directional silicon steel sheets (referred to hereinafter as steel sheets) which have the same length but different widths so that their combined cross-sections become substantially circular. In short, as shown in FIGS. 1A and 4, for strip-like steel sheets whose widths are W, thirteen types of widths are chosen as W between 2.0–7.2 mm, with the steel sheets being stacked according to increasing width from a steel sheet 501*a* having a narrowest width of 2.0 mm, then on to steel sheets 501*b*, 501*c*, 501*d*, 501*e*, 501*f*, 501*g*, 501*h*, 501*i*, 501*j*, 501*k*, 501*l* up to steel sheet 501*m* which has a widest width of 7.2 mm so that a cross-section of these stacked steel sheets is substantially half-circular in shape. Furthermore, on top of steel sheet 501*m*, steel sheets 501*n*, 501*o*, 501*p*, 501*q*, 501*r*, 501*s*, 501*t*, 501*u*, 501*v*, 501*w*, 501*x*, 501*y* of decreasing width are stacked up to steel sheet 501*z* which has the smallest width of 2.0 mm so that a cross-section of all these stacked steel sheets is substantially circular in shape. For the present embodiment, if each steel sheet 501*a, b, c, d, e, f, g, h, j, k, l, m, n, o, p, q, r, s, t, u, v, w, x, y, z* (hereinafter collectively referred to as steel sheets 501*a–z*) has a thickness of 0.27 mm, the diameter of the circle circumscribing the iron core 502 becomes 7.2 mm and so, an occupation rate of the iron core 502 with respect to the circumscribing circle becomes no less than 95%.

By welding end parts 502*a* and 502*b* through a laser welding process discussed later, steel sheets 501*a–z* which form the iron core 502 become joined together. The magnets 504, 506 which have polarities in a direction opposite the direction of the flux produced by excitation of the coil are respectively fixed at both ends of this iron core 502 using an adhesive tape.

These magnets 504, 506, for example, consist of samarium-cobalt magnets but, as shown in FIG. 2, by setting the thickness T of the magnets 504, 506 to above 2.5 mm, for example, neodymium magnets can also be used. This is because the construction of a so-called semi-closed magnetic path by means of an auxiliary core 508 fitted on the outer side of the primary spool 514 (further discussed later) reduces the diamagnetic field acting on the magnets 504, 506 to 2 to 3 kOe (kilo-oersteds), which is less than that of a closed magnetic path. By using neodymium magnets for the magnets 504, 506, an ignition coil 2 usable even at a temperature of 150° C. can be constructed at a low cost.

As shown in FIGS. 2 and 3, the secondary spool 510 which serves as a bobbin is molded from resin and formed in the shape of a cylinder having a bottom part and flange portions 510*a, b* at its ends. The iron core 502 and the magnet 506 are housed inside this secondary spool 510, and the secondary coil 512 is wound on the outer periphery of the secondary spool 510. An interior of the secondary spool 510 has an iron core housing hole 510*d* which has a substantially circular cross-section. The lower end of the secondary spool is substantially closed off by a bottom part 510*c*.

A terminal plate 34 electrically connected to a leader line (not shown) and which is drawn from one end of the secondary coil 512, is fixed to the bottom part 510*c* of the secondary spool 510. A spring 27 for making contact with the cap 15 is fixed to this terminal plate 34. The terminal plate 34 and the spring 27 function as spool side conducting members, and a high voltage induced in the secondary coil 512 is supplied to the electrode part of the ignition plug (not shown) via the terminal plate 34, the spring 27, the cap 15 and the spring 17. Also, a tubular part 510*f* which is concentric with the secondary spool 510 is formed at an opposite end 510*c* of the secondary spool 510.

Figure 6:
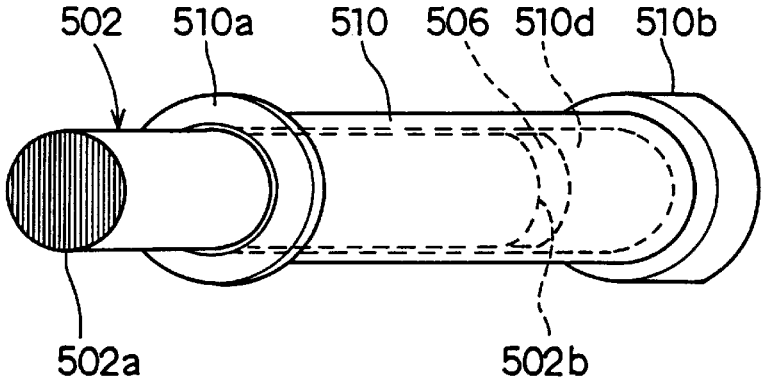
FIG. 6 is a diagram showing a secondary spool attached to the iron core of the first embodiment.

As shown in FIG. 6, the iron core which has the magnet 506 fixed in one end part is inserted into the iron core housing hole 510*d* of the secondary spool 510. As shown in FIGS. 2 and 3, the secondary coil 512 is wound around the outer periphery of the secondary spool 510. It must be noted here that while the steel sheets 501*a–z* which form the iron core 502 have been fixed via YAG laser welding, other methods can also be used for keeping the steel sheets 501*a–z* together. For example, steel sheets 501*a–z* can also be fixed by affixing circular binding rings at the end parts 502*a*, 502*b* of the iron core 502. Moreover, making the inner diameter of the iron core housing chamber 510*d* which is formed inside the secondary spool 510 smaller than the outer diameter of the iron coil and covering the opening of the iron core housing chamber 510 when the iron core is inserted would also fix the steel sheets 510*a–z*.

As shown in FIGS. 2 and 3, the primary spool 514 molded from resin is formed in the shape of a cylinder having a bottom and flange portions 514 *a, b* at both of its ends, with the upper end of the primary spool 514 being substantially closed off by a lid part 514*a*. The primary coil 516 is wound on the outer periphery of this primary spool 514.

A tubular part 514*f* concentric with the center of the primary spool 514 and extending up to the lower end of the primary spool 514 is formed in the cover part 514*c*. When the tubular part 514*f*, the secondary spool 510 and the primary spool 514 are assembled together, the tubular part 514*f* is positioned to be concentrically inside the tubular part 510*f* of the secondary spool 510. As a result, the iron core 502 having the magnets 504, 506 at both ends is sandwiched between the lid part 514*a* of the primary spool 514 and the bottom part 510*a* of the secondary spool 510 when the primary spool 514 and the secondary spool 510 are assembled together.

The control circuit part 7 is made up of a power transistor which intermittently supplies current to the primary coil 516 and a resin-molded control circuit which is an ignitor for producing a control signal of this power transistor. A separate heat sink 702 is fixed to the control circuit part 7 for releasing heat from the power transistor and the like.

As shown in FIGS. 2 and 3, the outer periphery of the primary spool 514 which is wound up with the primary coil 516 is mounted with an auxiliary core 508 that has a slit 508*a*. This auxiliary core 508 is made by rolling a thin silicon metal sheet into a tube and then forming the slit 508*a* along its axial direction so that the start of the rolled sheet does not make contact with the end of the rolled sheet. The auxiliary core 508 extends from the outer periphery of the magnet 504 up to outer periphery of the magnet 506. In this way, eddy currents produced along the circumferential direction of the auxiliary core 508 are reduced.

Meanwhile, the auxiliary core 508 may also be formed using, for example, two sheets of steel sheet having a thickness of 0.35 mm.

Next, the electrical energy (hereinafter called "the primary energy") needed by the primary coil 516 of the ignition coil 2 will be explained.

Normally, to ignite a gas mixture with a spark discharged by an ignition plug, electrical energy of over 20 mJ (millijoules) must be supplied to the ignition plug. To do this, considering an energy loss of 5 mJ due to the ignition plug and considering an additional margin of safety, the secondary coil 512 must produce a minimum of 30 mJ of electrical energy (hereinafter, the electrical energy produced in the secondary coil 512 will be referred to as the "secondary energy").

In this connection, based on the magnetism model shown in FIG. 5, calculation of the primary energy necessary in the primary coil 516 is carried out using a magnetic field analysis based on a finite element method (hereinafter referred to as "FEM magnetic field analysis"). Also, primary and secondary energy values are obtained through experimentation, and from the results of such, a study on the necessary conditions for the secondary energy to reach 30 mJ is carried out.

Figure 7:
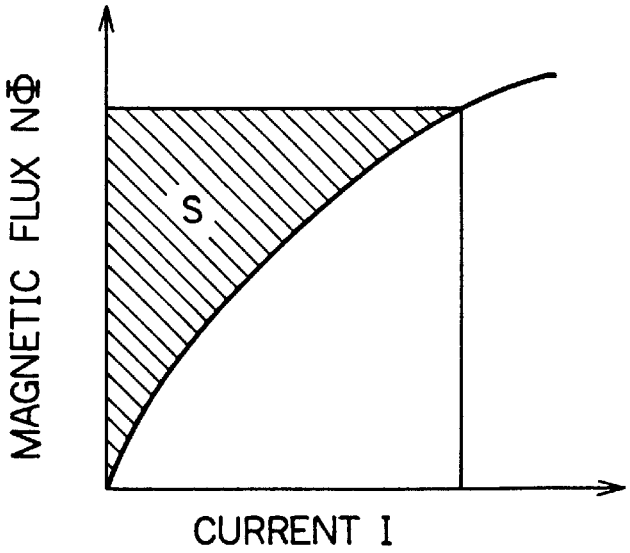
FIG. 7 is a characteristic curve showing the flux NΦ with respect to the primary coil current I of the ignition coil according to the first embodiment.

Here, the primary energy can be calculated by obtaining the area of the shaded area S shown in FIG. 7. More specifically, Eq. 1 is calculated using FEM magnetic field analysis.

$$W=\int_0^{\Phi} N\cdot I d\Phi \qquad 1$$

For Eq. 1, W represents the primary energy [J], N is the number of turns of primary coil, I is the primary coil current [A], and Φ is the primary coil flux [Wb].

Also, it has been confirmed through experiments that a primary energy of 36 mJ must be produced in the primary coil 516 in order to produce a secondary energy of 30 mJ in the secondary coil 512.

Figure 5:
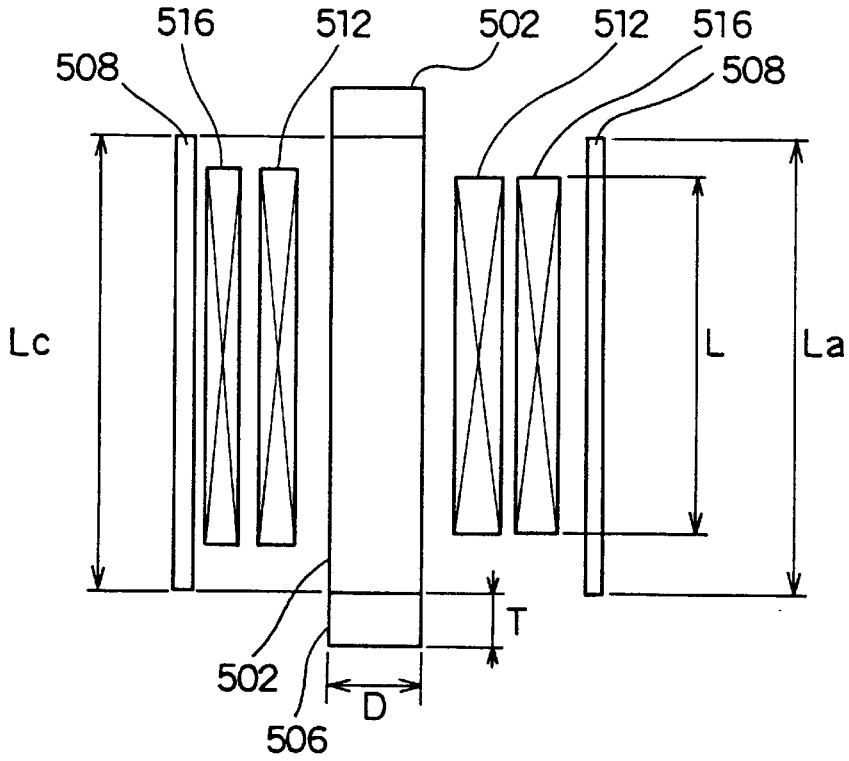
FIG. 5 is a magnetic model diagram of the ignition coil according to the first embodiment.
Figure 8:
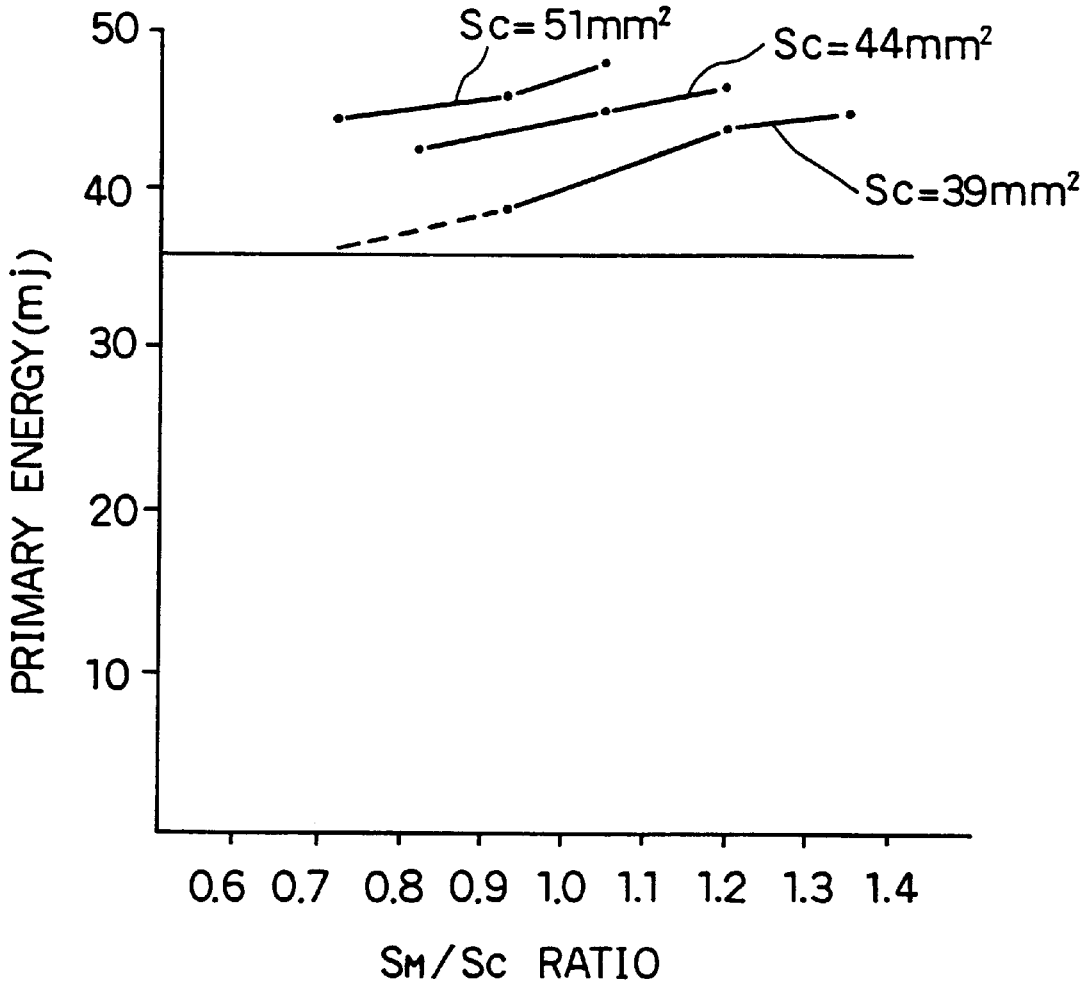
FIG. 8 is a characteristic curve showing the primary energy with respect to the ratio of the cross-sectional area $S_M$ of the magnets with cross-sectional area $S_c$ of the iron core of the ignition coil according to the first embodiment.
Figure 9:
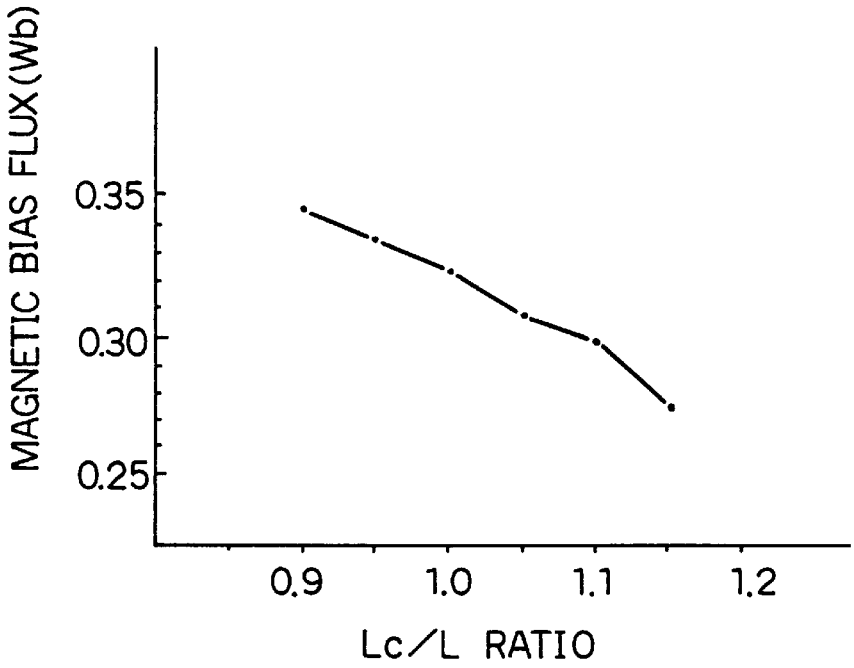
FIG. 9 is a characteristic curve showing the magnet bias flux with respect to the ratio of the axial direction length $L_c$ with the winding width L of the primary and secondary coils of the ignition coil according to the first embodiment.
Figure 10:
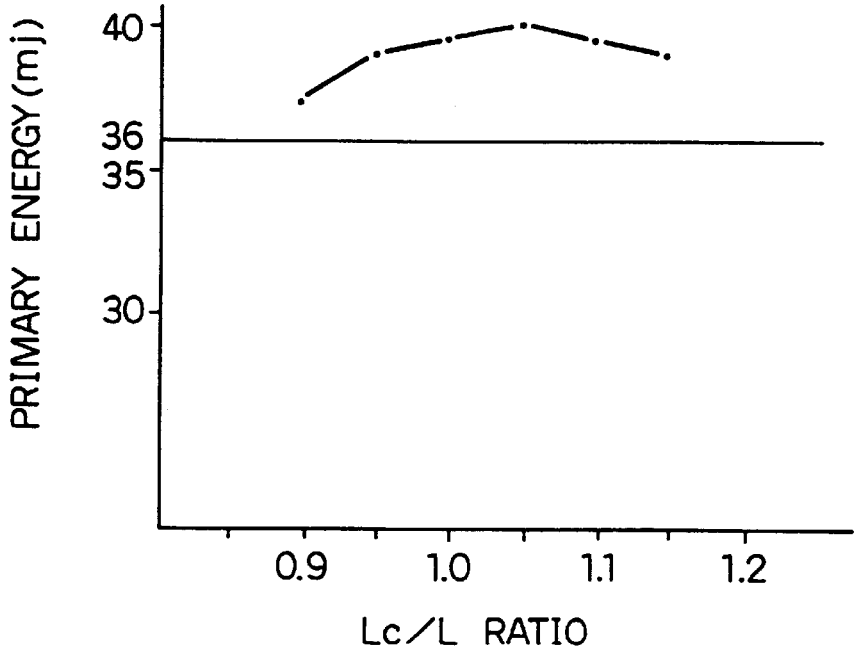
FIG. 10 is a characteristic graph showing the primary energy with respect to the ratio of the axial direction length $L_c$ with the winding width L of the primary and secondary coils of the ignition coil according to the first embodiment.

The results of the FEM magnetic field analysis carried out based on the magnetic model shown in FIG. 5 are shown in FIGS. 8–10. The primary energy and magnet bias flux characteristics are shown with the cross-sectional area $S_C$ of the iron core 502, the axial direction length $L_c$ of the iron core 502 and the cross-sectional area $S_M$ of the magnets 504, 506 as parameters.

The primary energy characteristic shown in FIG. 8 is obtained by varying the ratio of the cross-sectional area $S_M$ of the magnets 504, 506 with the cross-sectional area $S_C$ of the iron core 502 with a current of 6.5 A flowing through a primary coil 516 wound 220 times. Here, in FIG. 8, the dotted portion, where data collection was not performed, was obtained through estimation.

As shown in FIG. 8, the primary energy increases together with the increase in the $S_M/S_C$ ratio. Also, the primary energy increases with larger $S_C$ values. This is because the larger $S_M/S_C$ is, the better the magnet bias flux, which is due to the magnets 504, 506 disposed at both ends of the iron core 502 constituting a part of the magnetic path, acts. It can also be seen that, as described above, in order to produce a primary energy exceeding the 36 mJ which is the minimum primary energy for the primary coil 516, the cross-sectional area $S_C$ of the iron core 502 should be no less than 39 $mm^2$.

Accordingly, $S_M/S_C$ must be set to at least 0.7 and $S_C$ to at least 39 $mm^2$. Here, because the iron core 502 is made by laminating a directional silicon steel sheet, the external diameter D of the iron core 502 shown in FIG. 5 becomes very large due to a bulge arising on the outer periphery. For example, from the point of view of manufacturability, when a directional silicon steel sheet of sheet thickness 0.27 mm is used, an external diameter D of at least 7.2 mm is needed to make the practical cross-sectional area $S_C$ of the iron core 502 39 $mm^2$. However, because of restrictions on the external diameter dimension A of the case 100 covering the outer periphery of the primary coil 516, it is difficult to set $S_M/S_C$ over 1.4 and $S_C$ over 54 $mm^2$, so it is demanded that $S_M/S_C$ must be no more than 1.4 and $S_C$ must be no more than 54 $mm^2$. To make this cross-sectional area $S_C$ no more than 54 $mm^2$, with the same conditions described above, an external diameter D of 8.5 mm is necessary.

Therefore, by setting $S_M/S_C$ in the range $0.7 \leqq S_M/S_C$ 1.4 and $S_C$ ($mm^2$) in the range $39 \leqq S_c \leqq 54$ respectively, it will be possible to conform to a low cost design specification. Also, it is possible to increase the secondary energy without making the size and build of the case 100 large.

The characteristic curve of the magnet bias flux created by the magnets 504, 506 shown in FIG. 9 is obtained by varying the ratio of the axial direction length $L_c$ of the iron core 502 with the winding width L of the primary and secondary coils for the case when there is no current flowing through the primary coil 516 that is wound 220 times, that is, with no primary energy produced and when the axial direction length $L_a$ of the auxiliary core 508 is set to a fixed 70 mm. Here, the winding width L of the primary and secondary coils is set to 65 mm. This is based on the design specification of the primary coil 516 which tends to affect the size and build of the case 100. That is, because of the amount of heat produced by the power transistor constituting the ignitor and the starting characteristics of the internal combustion engine, there is a need that the resistance value of the primary coil 516 be in the range 0.5 to 1.4 Ω, and also it is necessary that the external diameter A of the case 100 be made at most 23 mm, and thus, the winding width L of the primary and secondary coils (mm) is set in the $50 \leqq L \leqq 90$ range.

As shown in FIG. 9, the magnet bias flux of the magnets 504, 506 decreases with larger $L_c/L$ ratios. This is because the larger $L_c/L$ is, that is, the longer the axial length $L_c$ of the iron core 502 becomes, the greater the distance between the magnet 504 and the magnet 506 becomes and so, the magnetization force of the magnets 504, 506 becomes less effective. This reduction in the magnet bias flux affects the increase of the primary energy shown in FIG. 10

The primary energy characteristic curve shown in FIG. 10 is obtained by changing the ratio of the axial direction length $L_c$ of the iron core 502 and the winding width L of the primary and secondary coils when a current of 6 A is flowing through the primary coil 516 that is wound 220 times and when the axial direction length $L_a$ of the auxiliary core 508 is fixed to 70 mm.

As shown in FIG. 10, the primary energy approaches an approximately maximum when $L_c/L$ is in the $1.0 \leqq L_c/L \leqq 1.1$ range and decreases on either side of this range. The primary energy decreases when $L_c/L$ becomes small because, as described above, the magnet bias flux increases when $L_c/L$ is smaller, but in combination with the axial direction length $L_a$ of the auxiliary core 508, the apparent magnetic resistance of the magnetic path increases. That is, with a fixed exciting force, the flux decreases and when $L_c/L$ becomes smaller than 1.0, the primary energy decreases. Also, the primary energy decreases when $L_c/L$ becomes greater than 1.1 because, as described above, the magnet bias flux decreases when $L_c/L$ increases.

Also, it has been confirmed that when $L_c/L$ becomes smaller than 0.9, because the space between the magnet 504 and the magnet 506 becomes narrow and the magnets 504, 506 greatly enter the respective wound wire ranges of the primary coil 516 and the secondary coil 512, the effective flux created by the primary coil 516 is reduced by the diamagnetic field of the magnets 504, 506. When $L_c/L$ becomes larger than 1.2, the space between the magnets 504 and 506 becomes wider with respect to the winding width L of the primary and secondary coils and thus, because the magnet bias flux ceases to be effective, it is necessary that $L_c/L$ be no more than 1.2. Therefore, by setting $L_c/L$ in the $0.9 \leqq L_c/L \leqq 1.2$ range, it is possible to further increase the primary energy produced by the primary coil 516.

According to the ignition coil for an internal combustion engine of this embodiment, by respectively setting the range of the transverse cross-sectional area $S_c$ of the iron core 502 ($mm^2$) to $39 \leqq S_C \leqq 54$, the range of the ratio of the cross-sectional area $S_M$ of the magnets 504, 506 with the cross-sectional area $S_C$ of the iron core 502 to $0.7 \leqq S_M/S_C \leqq 1.4$, the range of the ratio of the axial direction length $L_c$ of the iron core 502 with the winding width L of the primary and secondary coils to $0.9 \leqq L_c/L \leqq 1.2$, and the range of the winding width L (mm) to $50 \leqq L \leqq 90$, the primary energy produced in the primary coil 516 can be increased without increasing the external diameter A of the case 100. As a result, the secondary energy produced in the secondary coil 512 can be increased and the amount of rare earth magnets used is reduced. Also, by increasing the secondary energy without making the size and build of the case 100 large, the ignition coil 2 can be applied as is to a conventional plug tube and the gas mixture ignition performance of an internal combustion engine can be improved. Furthermore, because the use of relatively expensive rare earth magnets is reduced, the ignition coil 2 can be tailored to a low-cost design specification.

While the primary coil 516 is positioned on the outer side of the secondary coil 512 for the present embodiment, the primary coil 516 may be positioned on the inner side of the secondary coil 512 and in doing so, the same effects can also be obtained.

Also, in this embodiment, the magnets 504, 506 are disposed at the upper and lower ends of the iron core 502, but there is no need to be limited to this and by setting a suitable cross-sectional area of the iron core according to the amount of primary energy demanded by the internal combustion engine, a construction wherein there is one magnet or a construction wherein magnets are not used may be adopted.

Meanwhile, the interior of the housing chamber 102 which houses the transformer part 5 and the like is filled up with the insulating liquid 29 to an extent that a little space is left at the top end part of the housing chamber 102. The insulating liquid 29 seeps through the bottom end opening of the primary spool 514, the opening 514*d* provided at the substantially central portion of the cover 514*c* of the primary spool 514, the upper end opening of the secondary spool 510 and openings (not shown) to ensure that the iron core 502, the secondary coil 512, the primary coil 516, the auxiliary core 508 and the like are perfectly insulated from each other.

Figure 14:
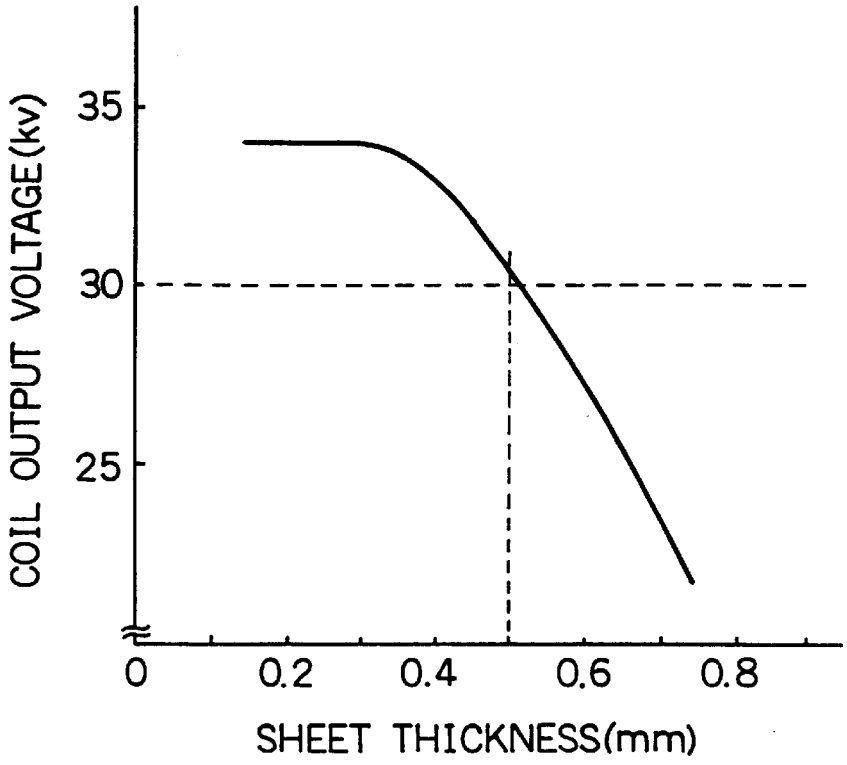
FIG. 14 is a characteristics diagram showing a relationship between the thickness of steel sheets which form the iron core and an output voltage of the ignition coil.
Figure 13:
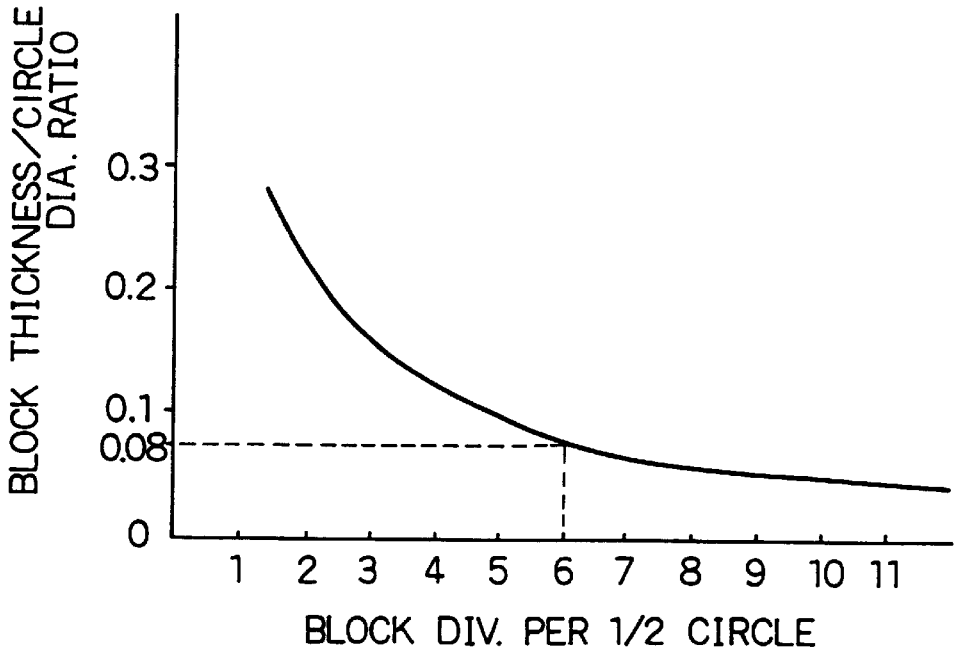
FIG. 13 is an explanatory diagram showing a relationship between the number of block divisions per half-circle of the circumscribing circle of the iron core and a ratio of the thickness of each block division with respect to a diameter of the circumscribing circle.
Figure 15:
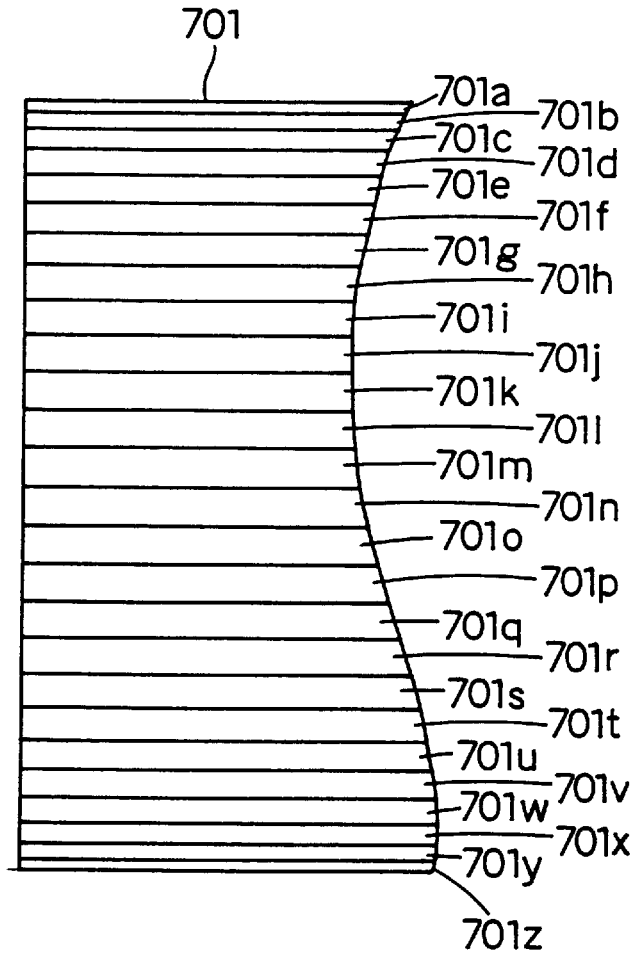
FIG. 15 is a diagram showing cutting positions of the steel sheet material for steel sheets having different widths.

Next, FIGS. 13–15 are used to explain the occupation rate of the iron core in the iron core housing chamber 510*d* which houses the iron core 502.

Here, a circle 500 which forms the contour of the inner wall of the iron core housing chamber is shown in FIG. 11. This circle corresponds to the circumscribing circle described before and hereinafter, and it shall be referred to as "circumscribing circle 500".

The occupation rate of the iron core 502 with respect to the area of the circumscribing circle 500 varies according to the number of stacked sheets which have different widths.

Figure 11A:
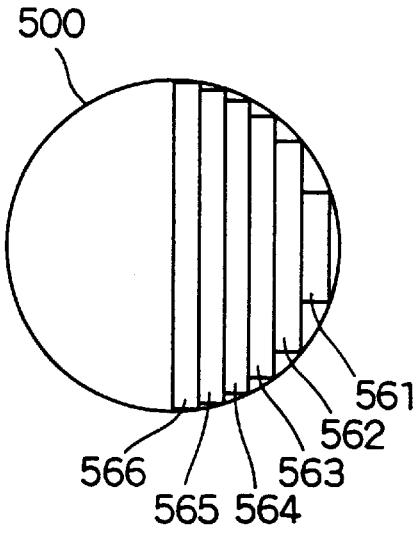
FIGS. 11A–C show variations of the iron core of the first embodiment.
Figure 11B:
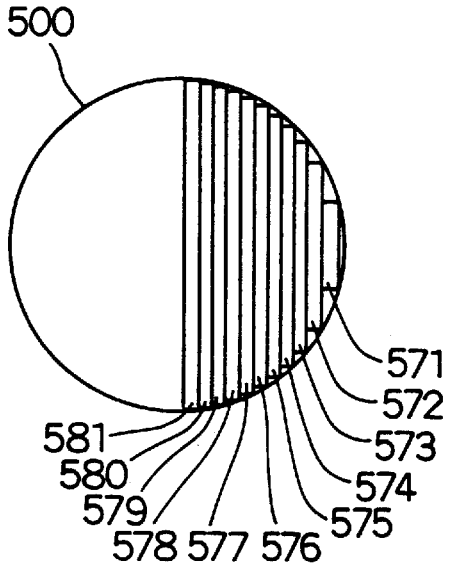

For example, FIG. 11A shows the case when steel sheets of six different widths are stacked within the half-circle of the circumscribing circle 500 to form the iron core 502. In short, the above-described steel sheets 501*a*–*m* of 13 types of widths shown in FIG. 11A which form a half-circle of the iron core 502 are replaced with a steel core shown in FIG. 11A which includes steel sheets 561, 562, 563, 564, 565 and 566. Here, the steel sheets 561, 562, 563, 564, 565 and 566 have the same thickness with their widths set to the greatest width while being within the circumscribing circle 500. Therefore, as shown in FIG. 11B, the occupation rate increases with reduction in the thickness of each individual steel sheet and with the increase in the number of steel sheets stacked. Here, the relation between the increase in the number of steel sheets stacked by decreasing the thickness of each individual steel sheet and the increase in the occupation rate can be expressed as a geometrical relationship. FIG. 12 shows a correlation between the number of metal sheets stacked and the occupation rate of the iron core 502. It must be noted here that FIG. 11 shows the occupation rate of metal sheets stacked to occupy one half of the circumscribing circle 500. Also, it must be noted that the number of metal sheets stacked is expressed here in terms of block divisions.

As shown in FIG. 12, the occupation rate for half of the circumscribing circle 500 increases with increase in the number of block divisions and at least 6 block divisions are needed to achieve an iron core 502 occupation rate of at least 90%. The occupation rate of the iron core 502 is set to no less than 90% so that the output voltage of the ignition coil 2 which is generated by the transformer unit 5 of the ignition coil becomes no less than 30 kV. Here, FIG. 11A shows a first variation where there are six block divisions while FIG. 11B shows a second case where there are eleven block divisions.

Meanwhile, while each block division can be thought to correspond to one metal sheet; the lesser block divisions there are, the thicker each metal sheets become. FIG. 13 shows the relation between the number of block divisions and the ratio of the thickness of each block division with the diameter of the circumscribing circle 500.

As shown in FIG. 13, when there are six block divisions occupying half of the circumscribing circle 500, the thickness of each individual block corresponds to 8% of the diameter of the circumscribing circle 500. Accordingly, for example, when the circumscribing circle has a diameter of 15 mm, the thickness of each block division becomes 1.2 mm. In other words, each of steel sheets 561–565 shown in FIG. 11A will have a thickness of 1.2 mm. Meanwhile, FIG. 14 shows the correlation between the thickness of each individual metal sheet with the output voltage of the ignition coil 2. From FIG. 14, it can be seen that when the sheet thickness becomes no less than 0.5 mm, the output voltage of the ignition coil becomes no greater than 30 kV. This is because the eddy current loss which occurs at the cross-section of the metal sheet becomes greater when the metal sheet becomes thicker. Therefore, if the output voltage of the ignition coil 2 is to be no less than 30 kV, the thickness of each metal sheet should be no more than 0.5 mm. Thus, when there are six block divisions that occupy half of the circumscribing circle 500, each block should be formed by stacking two or more steel sheets whose individual thickness is 0.5 mm and whose width are the same.

Figure 11C:
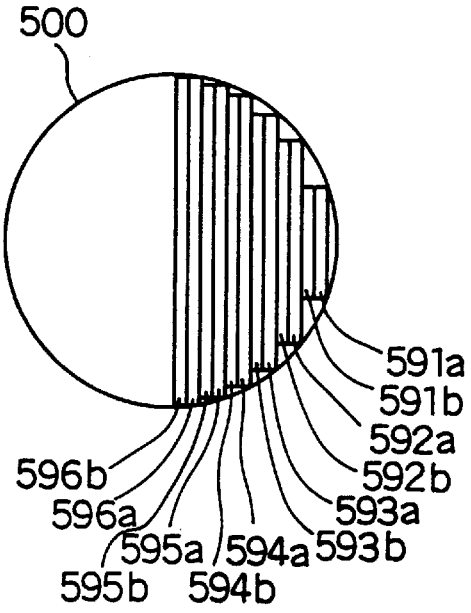
Figure 12:
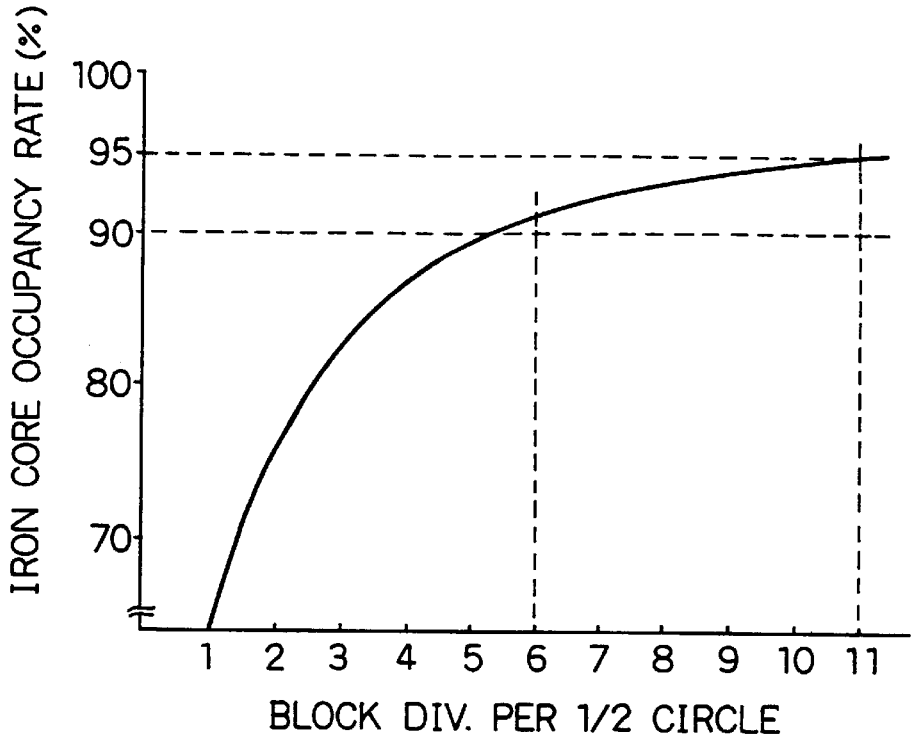
FIG. 12 is an explanatory diagram showing an iron core occupancy rate of block divisions per half-circle of a circumscribing circle of the iron core.

FIG. 11C shows a third variation wherein there are six block divisions provided with each block division being formed by stacking two metal sheets. According to this third example, because of the reduction in the thickness of metal sheets 591*a*, 591*b* which form one block and which have the same width, increase in eddy current loss can be reduced and thus, the ignition coil can generate an output voltage of no less than 30 kV.

In the second variation shown in FIG. 11B, when there are eleven block divisions, a 95% occupation rate of the iron core 502 can be achieved with each metal sheet 571–581 which corresponds to one block division being set to have a thickness of about 0.5 mm. In this way, an iron core 502 occupation rate of no less than 90% is achieved while ensuring that the output voltage of the ignition coil 2 is no less than 30 kV.

The processes for manufacturing the iron core 502 are explained using FIGS. 15–23.

The iron core 502 is manufactured by performing the following processes: a cutting process where a ribbon material 702 is derived by cutting a steel sheet material 701; a bundling process for making a bundled stack material 705 from the ribbon material 702; a chopping process for chopping the bundled stacked material 705 into iron core materials 707 of predetermined length; and a laser welding process for YAG laser welding the end parts of the iron core material 707. Each of the above processes are discussed below.

The cutting process is explained below.

Figure 16:
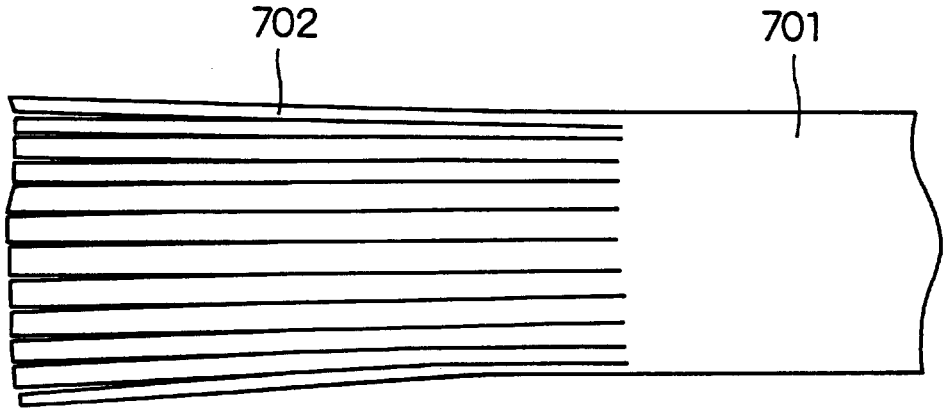
FIG. 16 is a diagram showing ribbon material that is derived by cutting the steel sheet material using the cutting process.

As shown in FIG. 16, in this cutting process, the cutter 710 cuts the broad, belt-shaped steel sheet 701 into the curtain-shaped ribbon material 702. As shown in FIG. 15, during this process, from an outer side to the inner side of the steel sheet material 701, the ribbons are displaced according to increasing width starting from ribbon 701*a* which has the narrowest width and going on to ribbons 701*b–l* up to ribbon 701*m* which has the greatest width and which is displaced at a substantially central portion of the ribbon material 701. In the same way, from the other outer side of the steel sheet material to its inner side, the ribbons are displaced according to increasing width starting from ribbon 701*z* which has the narrowest width and going on to ribbons 701*y,* 701*x,* etc. to ribbon 701*n*. In this way, by cutting the ribbon material 702 into ribbons 701*a–z* and displacing them in the above manner, these ribbons can be stacked easily in the bundling process which is discussed later.

Figure 17:
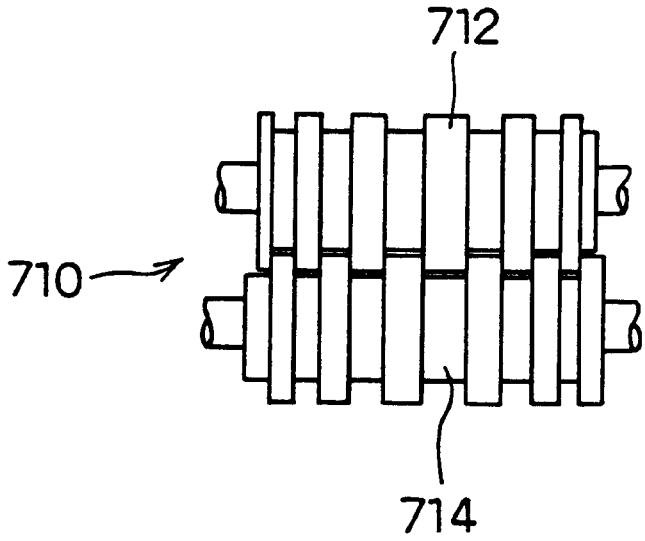
FIG. 17 is a diagram showing cutting rollers which cut the steel sheet material in the cutting process.
Figure 18:
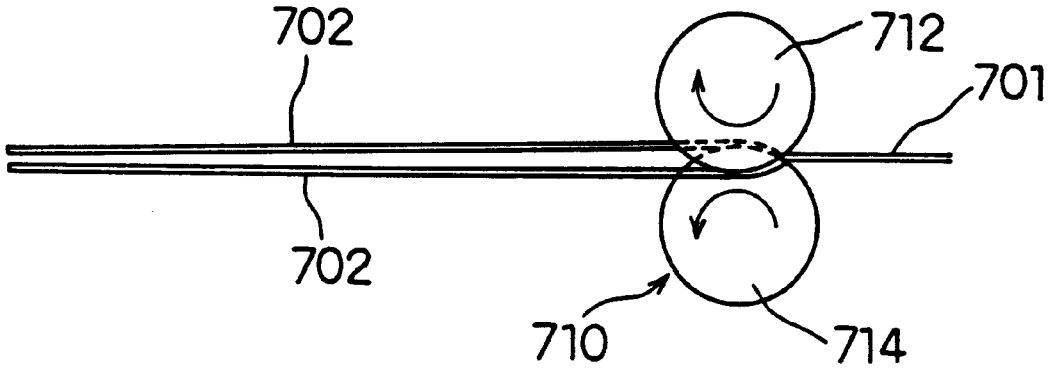
FIG. 18 is a diagram showing the cutting of the steel sheet material to derive the ribbon material during the cutting process.

As shown in FIG. 17, a cutter 710 which cuts the steel sheet material includes cutting rollers 712, 714. These cutting rollers are engaged to each other so that they cut up the steel sheet material 701 which passes between them into a curtain-like shape. FIG. 18 shows the cutter 710 cutting up the steel sheet material 701 with the right side of the same figure showing the steel sheet material 701 passing through the cutter 710 and the left side showing the resulting ribbon material 702.

Next, the bundling process is explained hereinafter.

Figure 19:
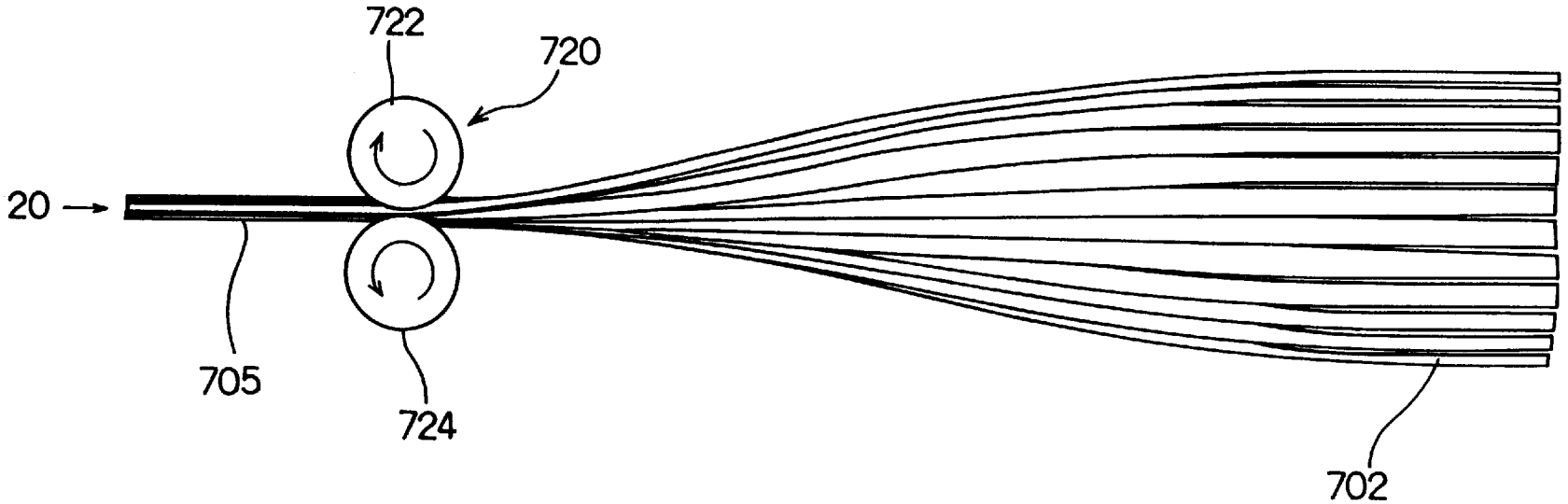
FIG. 19 is a diagram showing the bundling of the ribbon material during the bundling process.

As shown in FIG. 19, in the bundling process, the ribbon material 702 which has been cut up into a curtain-like shape is twisted and bundled. During this process, ribbons 701*a* and 701*z* which have the narrowest width are positioned to be at the outer portion and in between them, ribbons 701*b* and 701*y,* 701*c* and 701*x,* etc. are displaced according to increasing width. The ribbons are stacked by a bundling machine 720 so that ribbons 701*m* and 701*n* which have the widest width are positioned at the center.

Figure 20:
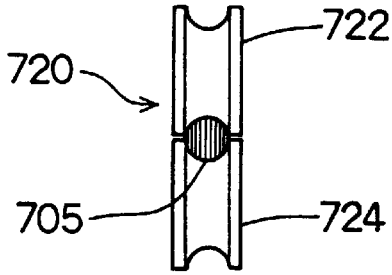
FIG. 20 is a diagram showing FIG. 19 as seen in the direction of the XV arrow.

As shown in FIGS. 19 and 20, the bundling machine 720 includes guide rollers 722, 724 with FIG. 19 showing the ribbon material 702 being guided from the right side to be swallowed and twisted between the guide rollers 722, 724. The twisted ribbon material 702 becomes the stacked material 705 shown in the left side of FIG. 19.

The chopping process is explained hereinafter.

Figure 21:
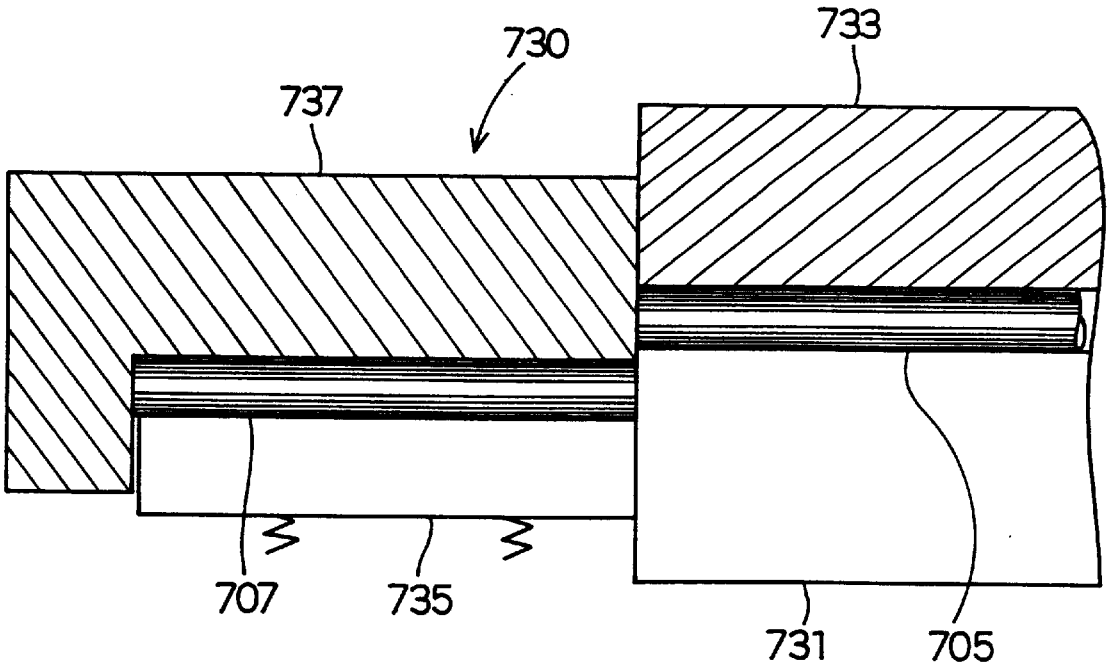
FIG. 21 is an explanatory diagram showing the chopping of the bundled stack material during a chopping process.

As shown in FIG. 21, a chopping machine 730 chops the stacked material 705 twisted in the bundling process. The chopping machine shown in FIG. 21 includes a die 731 and a mold 733 which fix the stacked material before chopping, a punch 737 which shears the stacked material 705 in the diametrical direction and a clamp 753 which holds the stacked material that moves during chopping. The stacked material 705 fixed by the die 731 and the mold 733 is chopped by a shearing process of the punch 737 which moves in the diametrical direction. In this way, an iron core 707 having a predetermined length is derived.

Next, the laser welding process is explained hereinafter.

Figure 22:
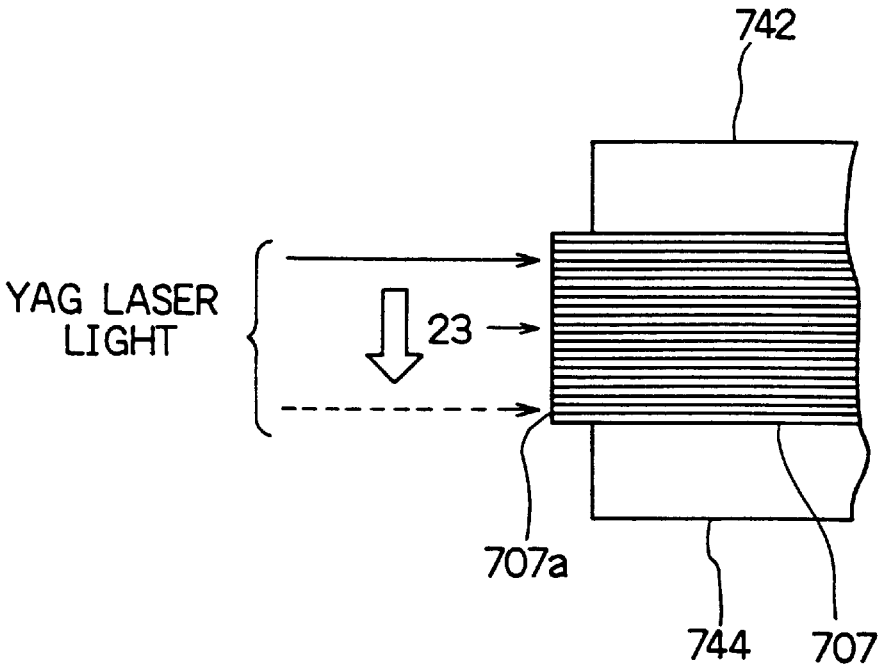
FIG. 22 is an explanatory diagram showing the YAG laser welding of the chopped iron core material during a laser welding process.
Figure 23:
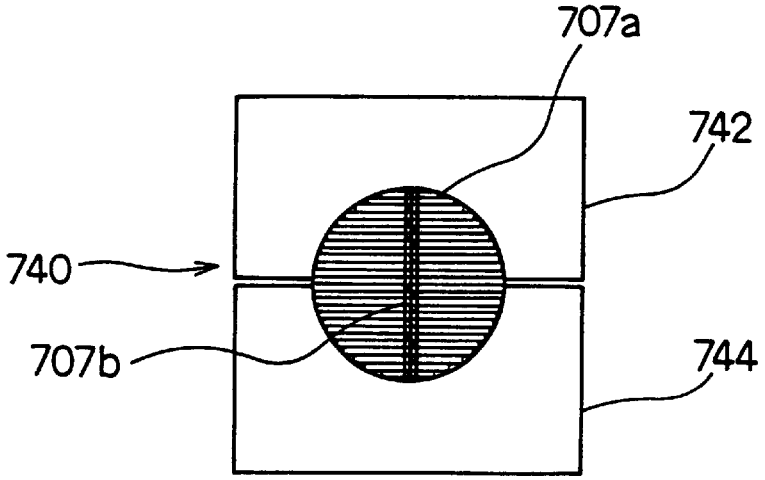
FIG. 23 shows FIG. 22 as seen from the direction of the XVIII arrow.

As shown in FIGS. 22 and 23, the iron core 707 is held in place by a pressing jig 740 which includes pressing parts 742, 744 so that steel sheets 501*a–z* which are layered ribbons 702*a–z* do not come apart. In this laser welding process, linear YAG laser welding is performed on a cross-section 707*a* formed during the chopping process discussed before. Because this YAG laser welding is executed linearly so that the welded path intersects with all the end surfaces of the stacked steel sheets 501*a–z,* adjacent steel sheets become welded with each other. FIG. 23 shows a welding mark 707*b*. Also, FIG. 22 shows the YAG laser welding process wherein a white arrow indicates a scanning direction of the illumination light of the YAG laser.

In this way, because the stacked steel sheets 501*a–z* do not come apart, the laser welded iron core material 707 can be used easily as the iron core 702.

Figure 24:
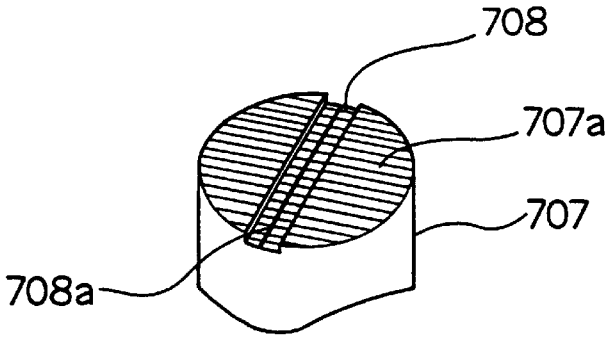
FIG. 24 is partial perspective diagram of a fourth variation of the iron core of the first embodiment.

Here, FIG. 24 shows a fourth example of the iron core 702. In this fourth example, a welding groove or ditch 708 is formed in the cross-section surface 707*a*, which is the end surface of the Iron core material, to run across all the stacked ribbon materials 702. The execution of the YAG laser welding procedure within this welding ditch 708 prevents the welding burr formed after the laser welding from coming off the cross-section 707*a*. In other words, by forming the welding ditch having a width wider than the YAG laser welding width on the iron core material 707 through a cutting procedure or the like, welding burrs which may be produced after welding do not come off the cross-section surface 707*a* and are contained within the welding ditch 708 and thus, chapping in the cross-section surface 707*a* is prevented. FIG. 24 shows a welding mark 708*a*.

Figure 25:
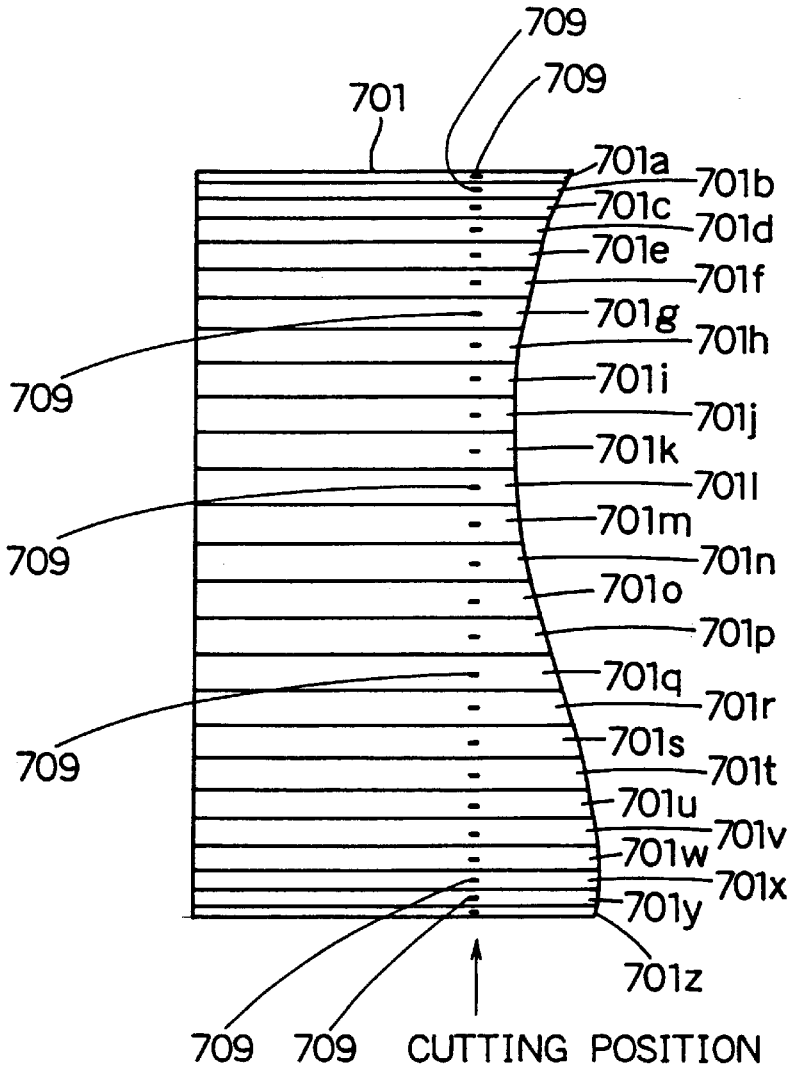
FIG. 25 is a diagram showing positions of hole parts constructed in the iron core material of the iron core of the first embodiment.

It must be noted here that the laser welding ditch 708 can formed be formed using procedures other than the cutting procedure. For example, as shown in FIG. 25, the laser welding ditch 708 can also be formed by forming a plurality of hole parts 709 in the steel sheet material 701 beforehand. Because these hole parts 709 are formed by the chopping procedure or the like so that they correspond with the predetermined position for cutting in the cutting procedure, parts of these hole parts 709 can be positioned in the cross-section surface 707*a* of the iron core material 707 which is cut to a predetermined length. Thus, the welding ditch 708 can be formed on the iron core material 707 without using the chopping process or the like.

Although the present invention has been fully described in connection with preferred embodiments thereof in reference to the accompanying drawings, it is to be noted that various changes and modifications will become apparent to those skilled in the art. Such changes and modifications are to be understood as being included within the scope of the present invention as defined by the appended claims.

What is claimed is:

1. An ignition coil comprising:

a core comprising a plurality of layers laminated diametrically, each layer being made of a steel plate, wherein the core has a longitudinal end surface, and a groove on the longitudinal end surface running across all of the layers.

2. An ignition coil as in claim 1, wherein the core has a welded line on the end surface, the welded line extending across all of the layers.

3. The ignition coil according to claim 2, wherein the groove is formed wider than the welded line to contain the welded line.

4. The ignition coil according to claim 3, wherein the groove is deeper than a height of the welded line.

5. The ignition coil according to claim 4, wherein the end surface of the core comprises a flat surface divided by the groove.

6. The ignition coil according to claim 2, wherein the welded line extends continuously from an endmost layer to the other endmost layer in a diametrical direction.

7. The ignition coil according to claim 1, wherein the groove extends continuously from an endmost layer to the other endmost layer in a diametrical direction.

8. The ignition coil according to claim 1, wherein the core has a welded mark on the groove, the welded mark is a line extending the entire length of the groove.

9. The ignition coil according to claim 8, wherein the welded mark is completely contained in the groove with respect to a longitudinal axis of the core.

10. An ignition coil as in claim 1, wherein said groove comprises a ditch formed in the end surface.

11. An ignition coil comprising:

a core having an end surface on which a plurality of diametrically laminated layers of steel plate are exposed, wherein the end surface is defined by a groove extending from one endmost layer to the other endmost layer in a diametrical direction and fiat surfaces located on both sides of the groove.

12. An ignition coil as in claim 11, wherein said groove comprises a ditch formed in the end surface.

13. A method for manufacturing an ignition coil, the method comprising:

cutting an element into a predetermined shape having a cut end;

assembling a plurality of elements cut in the cutting step into a core of the ignition coil by laminating the cut ends as a longitudinal end of the core; and perforating the elements before the cutting step to form a plurality of perforations at predetermined positions where the elements are cut to provide the cut end, and wherein the plurality of perforations on the cut ends are disposed in a line when the cut ends are laminated in the assembling step.

14. A method of manufacturing an ignition coil as in claim 13, wherein the perforations disposed in a line define a ditch in the longitudinal end.

15. An ignition coil manufactured by the manufacturing method in claim 3.

16. The method for manufacturing an ignition coil according to claim 13, wherein the material is a ribbon-shaped steel plate.

* * * * *